US008336620B2

(12) United States Patent
Williams et al.

(10) Patent No.: US 8,336,620 B2
(45) Date of Patent: Dec. 25, 2012

(54) WELL SEALS

(75) Inventors: Stephen Mark Williams, Bergen (NO); Truls Carlsen, Bergen (NO); Kevin Constable, Bergen (NO)

(73) Assignee: Statoil ASA, Stavanger (NO)

( * ) Notice: Subject to any disclaimer, the term of this patent is extended or adjusted under 35 U.S.C. 154(b) by 337 days.

(21) Appl. No.: 12/712,874

(22) Filed: Feb. 25, 2010

(65) Prior Publication Data

US 2011/0048701 A1 Mar. 3, 2011

(30) Foreign Application Priority Data

Aug. 28, 2009 (GB) ..... 0915010.3

(51) Int. Cl.
*E21B 47/10* (2012.01)
*E21B 47/06* (2012.01)

(52) U.S. Cl. ..... 166/250.08; 166/250.01; 166/250.02; 166/66

(58) Field of Classification Search ..... 166/250.01, 166/253.1, 250.02, 250.08, 250.14, 66, 268
See application file for complete search history.

(56) References Cited

U.S. PATENT DOCUMENTS 2,928,247 A * 3/1960 Hubbell ..... 405/54
2006/0266520 A1* 11/2006 Wydrinski et al. ..... 166/250.08

* cited by examiner

*Primary Examiner* — Brad Harcourt
(74) *Attorney, Agent, or Firm* — Patterson Thuente Christensen Pedersen, P.A.

(57) ABSTRACT

A method for determining integrity of annular seals in wellbores. In an embodiment, two wellbores are selected that extend through a common geological formation which is capable of sealing against casing sections located in the wellbores. A pressure test is typically carried out in a first of the wellbores to check that the formation provides an effective seal, and a logging tool is typically run to obtain well log data from which can be derived a characteristic response that is associated with the formation providing an effective annular seal around the casing section in the first wellbore. A logging tool may then be run in the second of the wellbores to obtain a second set of well log data, which are comparable with the characteristic response to determine whether the formation provides an effective annular seal in the second wellbore.

21 Claims, 3 Drawing Sheets

WELL SEALS

RELATED APPLICATION

The present application claims priority to GB Application No. 0915010.3 filed Aug. 28, 2009, which is incorporated herein in its entirety by reference.

TECHNICAL FIELD

The present invention relates to well seals, and in particular, but not exclusively, to a method of determining integrity of an annular seal in a wellbore. In particular embodiments, it relates to well seals in well tubular annuli and to identifying and qualifying such seals as an effective annular barrier.

BACKGROUND ART

In various circumstances, wells that have been drilled into the earth need to be sealed off to prevent escape of well fluids upward through the well and well annulus to the earth's surface into the sea or into another geological layer. This can be particularly important in a "sidetrack" drilling operation where a drill string is run into a pre-existing cased wellbore and is used to drill a new sidetrack wellbore through the casing wall of a pre-existing wellbore to access a new region of the subsurface. In such an operation, the well track of the pre-existing well needs to be sealed off and abandoned below the point of entry of the new sidetrack well.

In the oil and gas industry, certain standards must be met before a well can be abandoned. International ISO, EN, API and DnV standards form the guiding standards for such activities. More specific regulations and policies have also been put in place that guide sidetracking, abandonment and drilling operations. Such guidelines and policies typically include the following requirements for sealing off a well:

a. Multiple barrier seals are required, such that if a single barrier fails a second barrier exists to prevent leakage;
b. Each barrier element should be verifiable through some form of testing;
c. Permanent well barriers must be in place prior to well sidetracks, suspension and abandonment; and
d. A permanent well annular barrier should be impermeable, non-shrinking and ductile (to withstand mechanical loads/impact). It should also have long term integrity, resistance to different chemicals/substances (e.g., $H_2S$, $CO_2$ and hydrocarbons) and display wetting to ensure bonding to steel.

Before commencing a drilling or well intervention operation it is necessary to document existing barriers and to determine any need for testing existing barriers or creation of additional barriers in order to comply with the industry guidelines, standards and policies. Candidate wells for such operations often lack the necessary certification and/or the required annular barriers.

Typical oil and gas wells are constructed with a casing or other lining tubing. Casing is originally installed by running a casing string, which includes the casing section to be installed, into the wellbore. The casing string is fitted with a casing shoe at its leading end to penetrate the wellbore. When the string is located at a desired installation location in the wellbore, the casing section is usually cemented in place. Cement is pumped into the inside of the casing string and down to the casing shoe. The cement is then pumped back upward toward the surface via the casing shoe into the annular space (or casing annulus) defined between the wellbore wall and an outer surface of the casing section. The cement is then left to harden, thereby fixing the casing in place. The cementation may be incomplete along the length of the casing, such that cement may only be present in the annulus in certain intervals.

When the cement in the annulus does not provide suitable or sufficient annular seals various known techniques are used to ensure that such wells are suitably sealed in line with industry regulations. These techniques are remedial in nature involving formation of new annular seals in the well. Typically, remedial operations require cutting or perforation of the casing and pumping or squeezing extra cement into the area which requires additional sealing. Such operations can be time consuming and expensive, and may damage the casing. In addition, success rates for such operations are typically not high.

SUMMARY OF THE INVENTION

According to an embodiment of the invention there is provided a method of determining integrity of an annular seal in a wellbore, the method comprising the steps of:

(a) providing a characteristic response that is associated with a geological formation providing an effective annular seal around a lining tubing section located in a wellbore;
(b) running at least one wellbore tool in a selected wellbore that extends through the geological formation to obtain selected wellbore response data associated with a property of the geological formation; and
(c) comparing the selected wellbore response data with the characteristic response to determine whether the geological formation forms an effective annular seal around a lining tubing section located in the selected wellbore.

The method may include the steps of:

(d) selecting first and second wellbores that extend through a common geological formation which is capable of sealing against first and second lining tubing sections located in the first and second wellbores respectively;
(e) performing a seal test in the first wellbore to determine that the geological formation forms an effective annular seal around the first lining tubing section of the first wellbore;
(f) running at least one wellbore tool in the first wellbore to obtain first response data associated with a property of the common geological formation and deriving the characteristic response from the first response data; and
wherein the selected wellbore is the second wellbore and step (b) is performed in the second wellbore to obtain the selected wellbore response data in the form of second response data which are compared with the characteristic response according to step (c).

One or more of the steps (a) to (f) may be performed in a different order.

The geological formation may be a shale formation or other geological formation. In particular, the geological formation may be a ductile formation which can creep under load applied by overlying formations for example into a wellbore drilled through the ductile formation. The method may include indentifying a geological formation that may be capable of providing an annular seal.

Step (e) may include performing a pressure test in the first wellbore. Performing the pressure test may include pumping fluid into the first wellbore to increase pressure in the first wellbore to above at least a maximum predetermined pressure. The maximum predetermined pressure may be the maximum expected pressure to which the seal could be exposed to by well fluids. Typically, fluid may be pumped to a pressure that exceeds the maximum expected pressure that well fluids would be able to apply to the annular seal.

Performing the pressure test may include perforating the first lining tubing section. The pressure test may include determining whether there is fluid flow across the geological formation which provides the annular seal in the first wellbore. The pressure test may include measuring pressure in the wellbore and/or in the annulus on a first and/or second side of the formation, e.g., above and/or below the geological formation. In particular, the pressure test may include pressurising fluid in the first wellbore on a first side of the formation and may include measuring and/or monitoring fluid pressure on a second, opposite side of the formation. Thus, it is possible to check that there is no pressure or flow transmitted through the annular seal.

Performing the pressure test may include measuring a fracture pressure or leak off pressure for the geological formation.

The step of performing the pressure test in the first wellbore may include estimating an expected strength of the formation from reservoir models and may include comparing results from the pressure test with the estimated expected strength to verify that the formation provides an effective annular seal around the first lining tubing section. The pressure test may include comparing the fracture pressure with the estimated expected strength to determine that the geological formation forms an effective annular seal around the first lining tubing section.

The seal test may be an extended leak off test.

Step (e) may include performing an inflow test in order to prove that the formation provides effective annular seal.

The first and/or second response data may include variable density log (VDL) data obtained by running a wellbore tool in the form of a cement bond logging tool in the first and/or second wellbores. The first and/or second response data may include cement bond log (CBL) data obtained by running a wellbore tool in the form of a cement bond logging tool in the first and/or second wellbores.

The at least one wellbore tool may include a radially segmented cement bond logging tool, and the first and/or second response data may be obtained by running the radially segmented cement bond logging tool. Such a radially segmented cement bond logging tool may be provided with measurement pads adapted to be biased, e.g., by a spring, against the lining tubing, and/or adapted to perform multiple measurements at different azimuths.

The first and/or second response data may include ultrasonic azimuthal bond log data obtained by running a wellbore tool in the form of an ultrasonic scanning tool in the first and/or second wellbores. The ultrasonic scanning tool may be adapted to transmit and/or detect an ultrasonic pulse at multiple azimuths around an inner circumference of the lining tubing.

Typically, at least two wellbore tools are run in the first and/or second wellbores. This may help to restrict ambiguity in the first and/or second response data.

The method may include running the same wellbore tool in the first and second wellbores. Alternatively, the method may include running different wellbore tools in the first and second wellbores. The method may include the step of calibrating the wellbore tool which may be run to provide second response data that can be validly comparable to the first response data.

The method may include the step of drilling a further wellbore, for example a sidetrack wellbore, through the lining tubing section in the selected wellbore and/or first and/or second wellbores. Thus, the method can be a method of drilling a well.

According to an embodiment of the invention, there is provided wellbore apparatus for performing a method according to the above described method. The apparatus may include at least one logging tool for obtaining first and second response data, and may include pressure testing apparatus for verifying that the wellbore formation forms an effective annular seal around a lining tubing section.

BRIEF DESCRIPTION OF THE DRAWINGS

There will now be described by way of example only embodiments of the invention with reference to the accompanying drawings in which.

DETAILED DESCRIPTION

Figure 1:
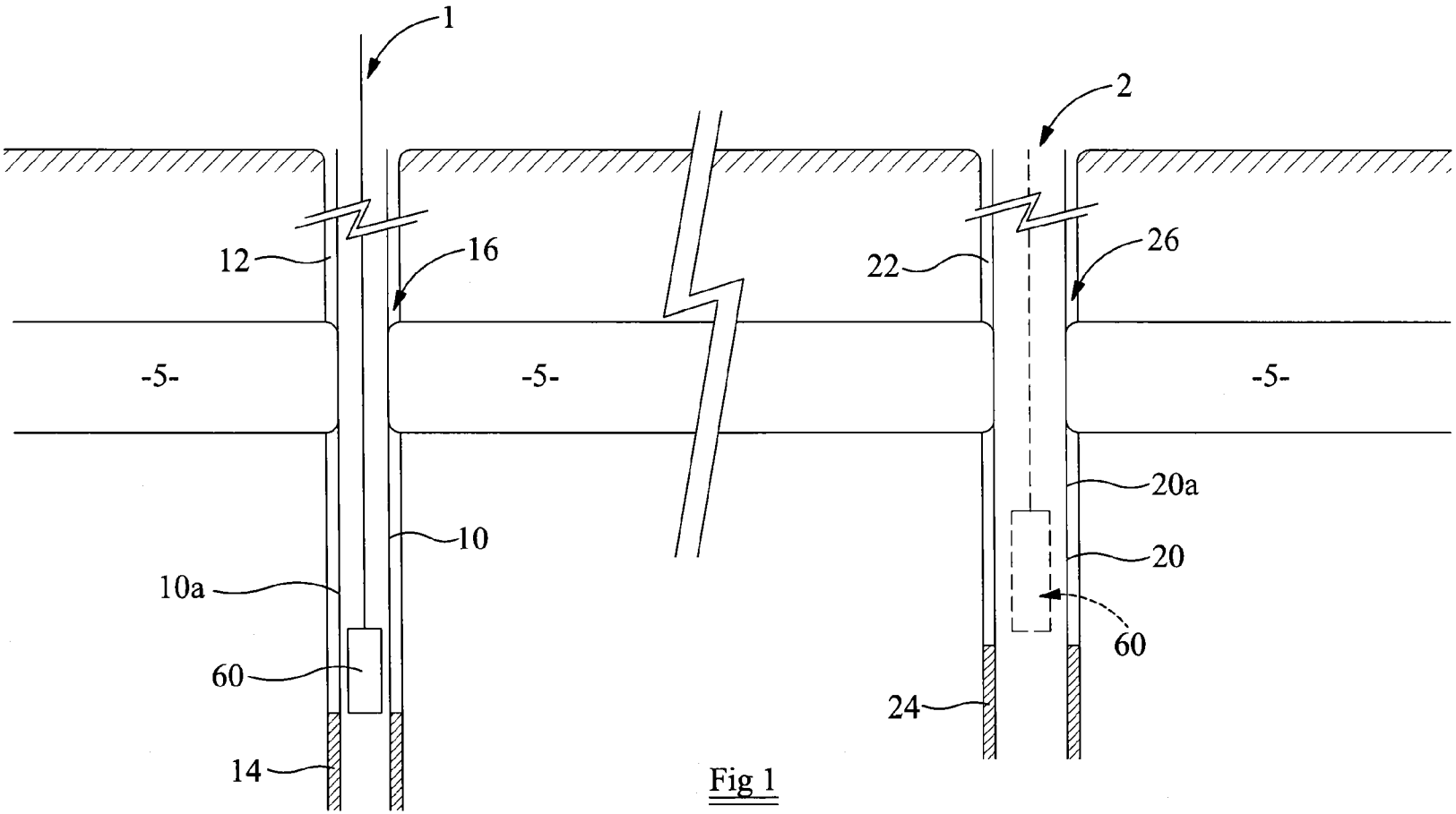
FIG. 1 is a cross-sectional representation of first and second wellbores extending through a common geological formation.

With reference firstly to FIG. 1, two well bores 1, 2 in different locations are shown extending from the earth's surface through a geological formation in the form of a shale formation 5 which has undergone lateral creep. The well bores 1, 2 are lined with casing sections 10, 20 defining annular spaces or casing annuli 12, 22 defined between outer surfaces 10*a*, 20*a* of the casing sections and walls of the wellbores 1, 2. In lower regions 14, 24 of the wellbores 1, 2, the casing sections are cemented in place, but above in regions 16, 26, cementation is incomplete to the extent that the cement itself does not provide the necessary sealing of the wellbore annuli 12, 22 for abandonment of the well track or for conducting a side track operation.

In this case, the shale formation 5 has crept laterally due to natural causes over time and is shown, in FIG. 1, in abutment with the casing sections 10, 20 in the regions 16, 26 of the casing annuli where there is no cement. The following steps are carried out to verify that the shale formation 5 forms a seal that functions as an effective annular barrier.

Figure 2:
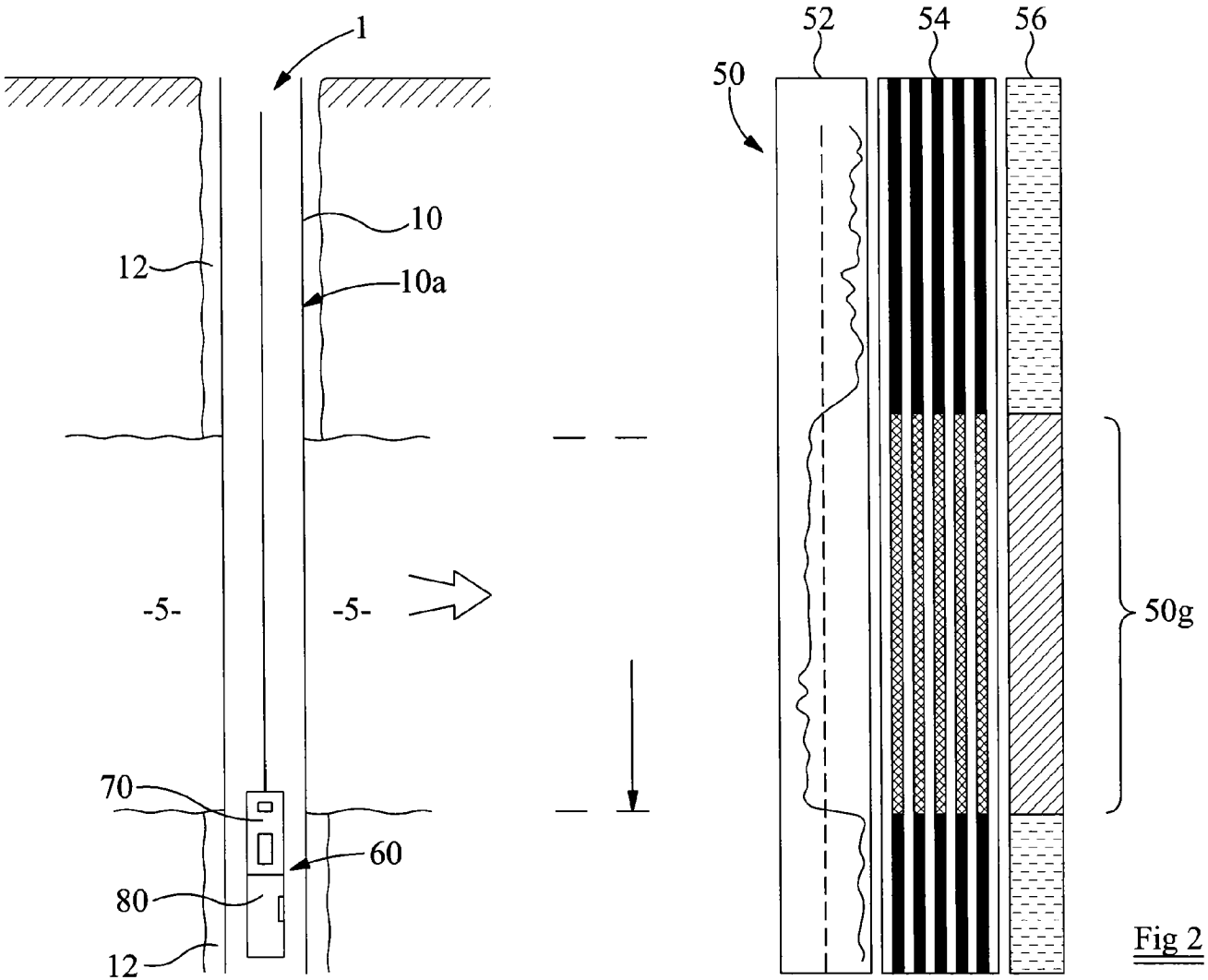
FIG. 2 is a schematic representation of a logging operation and corresponding well logs conducted in the first wellbore of FIG. 1.

With further reference to FIG. 2, a logging string 60 is located initially in the first wellbore 1, and a first logging run is completed in the first wellbore 1 by running the logging string 60 along the wellbore 1. The logging string 60 includes conventional logging tools 70, 80 which transmit signals into a wall of the wellbore and which detect responses that are recorded in wellbore logs 50. In this example, the logging string includes cement bond logging tool 70, and an ultrasonic scanning tool 80. These tools are used, as is known in the art, to obtain a Cement Bond Log(CBL) 52, a Variable Density Log (VDL) 54 and an ultrasonic azimuthal bond log 56. These wellbore logs 50 provide data concerning the quality and strength of bonding of material present in the casing annulus 12 against the outer surface 10*a* of the casing section 10.

The cement bond logging tool 70 uses a transmitter to transmit acoustic pulses and a receiver to detect signal strength and pattern of the return pulse response. The resulting CBL 52, records an amplitude of the sonic pulse response from the casing for each depth. The VDL 54, records amplitudes of the received pulse response including casing arrivals from the casing, pressure wave (P-wave) arrivals 76*m* from the formation behind the casing, and shear wave (S-wave)

arrivals 76*u* for each depth to provide an amplitude pattern across the log. The ultrasonic bond log 56 records acoustic impedances of the media behind the casing across the ultrasonic bond log 56 for each depth and for different azimuths in the well, thereby providing an image with different contrast indicating different impedance values.

In FIG. 2, a "good" log response 50*g* is seen in the region of the creeping shale formation 5. The CBL 52 indicates amplitudes of 20 mV or less across the shale interval, the VDL 54 has a low contrast pattern indicative of relatively strong formation arrivals, and acoustic impedances from the ultrasonic bond log 56 are in the region of 3 to 4 MRayl with good azimuthal coverage. These log responses together confirm that the shale formation has crept into contact with and formed a seal against the outer surface 10*a* of the casing 10. Above and below the shale formation CBL amplitudes are consistently above 20 mV, VDL data have a high contrast casing signal (parallel lines) and weak formation signal arrivals, and acoustic impedance values are less than 2 MRayl in many places, indicating, in contrast to the region of the shale seal, a fluid filled annulus 12.

In order to verify that the identified seal provided by the shale formation 5 can function as a barrier as defined under industry regulations, a strength test is carried out in the first wellbore 1 in the form of an extended leak off test (XLOT) applied to the formation 5. The purpose of the XLOT is to check that the formation is sufficiently strong to withstand the expected wellbore pressures, and to check that there is no fluid communication in the annulus 12 across the formation 5 at such pressures.

This is done by performing a pressure test in the first wellbore 1. In this test, the pressure in the wellbore annulus below the formation 5 is increased and the fracture pressure or leak off pressure is measured. This may be done for example by disposing pressure sensors in the wellbore and monitoring pressure during the test. The casing may be perforated below or near the base of the formation to provide the necessary communication between the wellbore and the casing annulus below the formation 5.

The leak off pressure is compared with the maximum expected pressure that well fluids could exert on an annular well barrier, for example if a gas column is created in the casing annulus extending from the reservoir to the base of the barrier. If the leak off pressure is sufficiently above the maximum expected pressure that well fluids could exert on an annular well barrier, this indicates that there is no leakage across the formation and that the seal provided by the geological formation 5 is qualified as an effective annular barrier. On the other hand, if the leak off pressure is measured to be below the maximum expected pressure that well fluids could exert on an annular well barrier, the seal may not be qualified as a barrier.

The strength of the formation 5 and its resistance to wellbore pressure is dependent on the minimum horizontal stress of the formation. Therefore, a further part of the XLOT test may include estimating the minimum horizontal stress from an earth stress model of the oil or gas field. A further step in order to qualify the seal as an annular barrier may therefore be to check that the measured leak off pressure is consistent with the stress estimations. It may also include estimating the maximum pressure that could be applied naturally at the seal due the wellbore fluids beneath.

When the seal is tested to provide an effective annular barrier, the "good" log response 50*g* associated with the shale formation 5 in the first wellbore 1 is in turn qualified as a characteristic response for the shale formation as an effective annular barrier. Thus, the characteristic response is a reference standard response for the shale formation 5 as an effective annular barrier, and the characteristic response can thereafter be used to qualify shale formation seals directly in other wells.

Figure 3:
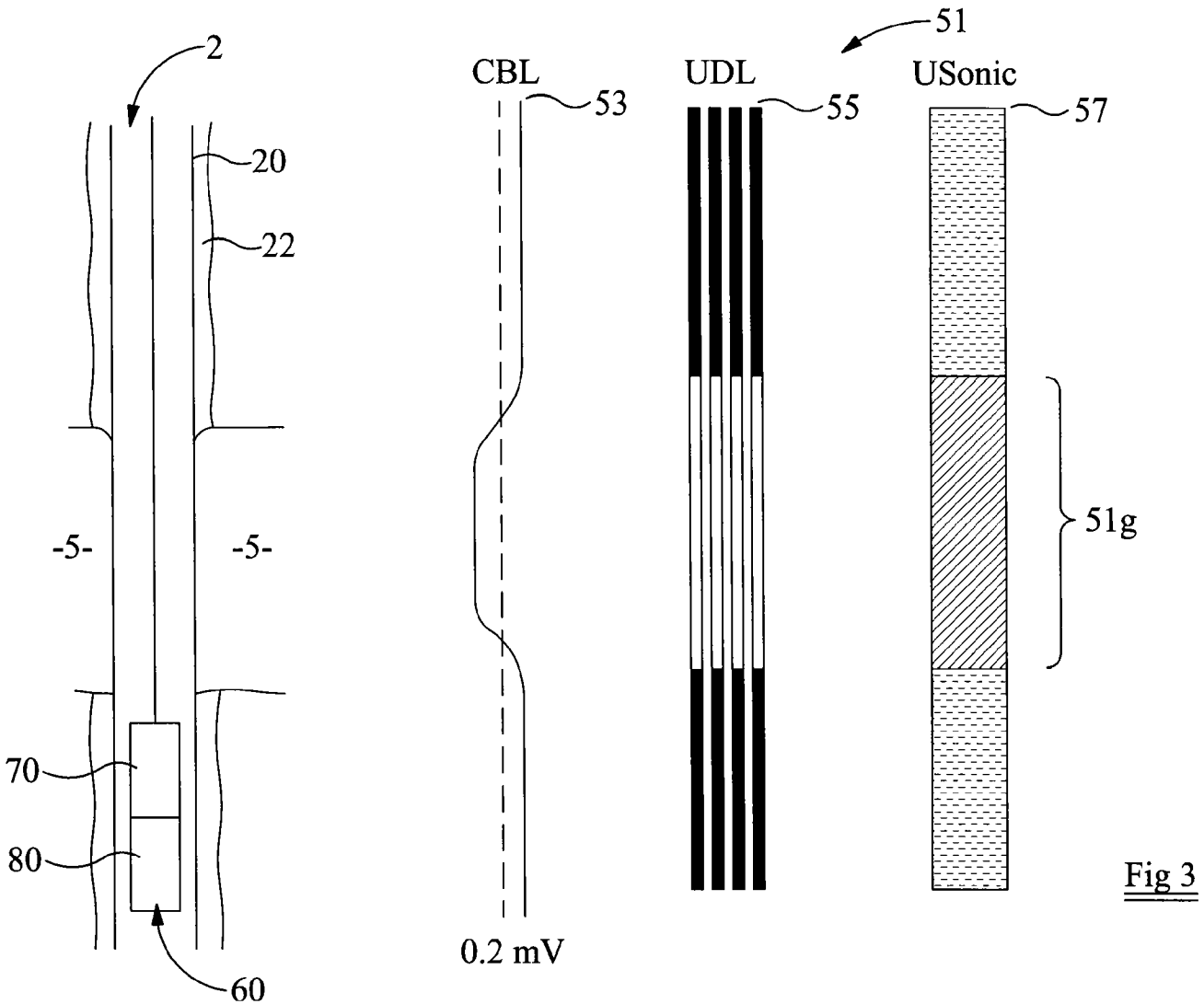
FIG. 3 is a schematic representation of a logging operation and corresponding well logs conducted in the second wellbore of FIG. 1.

For example, in FIGS. 1 and 3, the second well 2 transects the same, common, shale formation 5. The logging string 60 is run in the second wellbore 2 in a similar way to the logging run in the first wellbore 1. The string 60 contains the same logging tools 70, 80 and well logs 51, including a CBL 53, VBL 55 and ultrasonic azimuthal bond log 57, are obtained for the second well 2.

As shown schematically in FIG. 3, the well logs 51 show consistent responses across the formation interval. The CBL 53 has amplitudes of less than 0.2 mV, the VDL 55 has a low contrast response, and the ultrasonic bond log 57 displays acoustic impedances of 3 to 4 MRayl, providing a good log response 51*g* associated with the second well that is similar to the characteristic response 50*g* determined for the formation 5 in the pressure tested first wellbore 1. Based on the similarity of responses 50*g* and 51*g*, the shale formation 5 in the second wellbore 2 is qualified as an effective seal that provides an annular barrier.

Thus, by comparing the response from the second wellbore 2 with the characteristic response derived from the first wellbore 1, a seal provided by a shale formation can be qualified as an annular barrier directly from performing a logging operation in the second well 2, without pressure testing in the second well 2. The technique can be applied similarly to further wells by performing a logging run in the well and qualifying a seal or suspected seal formed by the same shale formation 5 directly from acquiring and interpreting the well log data from the further well, without conducting a pressure test in the well. This is a convenient and cost efficient way to determine whether a shale seal is a suitable seal for abandoning a well track.

In other examples, if the wellbore logs from the second or subsequent wells (in which no pressure testing has taken place) indicate an inferior seal, the seal is not qualified to be an effective annular barrier seal.

In other embodiments, minimum criteria are set which the responses recorded in the well logs of the second or further well must meet in order to be qualified without a pressure test. These are based on the expected responses for formations that are strongly bonded to casing. The criteria require CBL amplitudes to be less than 20 mV for at least 80% of the interval, VDL data to have a low contrast casing signal and clear formation signal arrivals, and acoustic impedance determinations from the ultrasonic azimuthal bond log to be above 3 MRayl for all azimuthal measurement points. In addition, well log responses must show good bonding of the shale formation 5 continuously for a minimum interval of 50 m. These conditions are met in the examples described above in relation to FIGS. 1 to 3.

Once the shale formation has been confirmed to provide an annular barrier in the first and/or second wells, the well track in these wells can be satisfactorily abandoned, and further operations can be carried out. With reference to the examples described above, a sidetrack drilling operation may for example initiated by using a whipstock to mill through the casing, above the top of the shale formation 5, and then the new sidetrack is drilled into a new region of the reservoir.

In variations of the method described above, separate logging tools are used in the first and second wellbores. The logging tools may be run at different times, for example, successively. The logging runs in the first and/or second wellbores may also be repeated, for example, to improve data quality. In addition, tools are typically calibrated before use in the second well to ensure that the log responses detected in the second well are validly comparable with the log responses detected in the first well.

In addition, it will be understood that initial identification of wells that transect shale formations can be carried out from geological maps, reservoir maps, and/or plots of existing well trajectories. Identification of a suitable shale formation that may creep over time to function as an annular barrier can be carried out using rheological models of the reservoir, historical well log records, and/or lithological logs made at the time of originally drilling the well. For example, this may include identifying suitable zones in the well with geological formations likely to produce an annular seal. These steps are typically carried out in the planning phase before running logging tools or performing other steps of the method.

The present invention provides significant advantages. Firstly, it makes use of geological formations which have, due to natural causes, crept and impinged onto the outside of a lining tubing in a wellbore and created an annular seal in the wellbore annulus. In addition, it allows the seals formed by the geological formation in such wellbores to be qualified as an annular barrier without a pressure test being carried out, in particular where the formation is proved to be strong enough to prevent leakage of well fluids across the seal. These features of the invention help particularly to reduce costs.

Various modifications may be made without departing from the scope of the invention herein described. For example, instead of or in addition to a pressure test, an inflow test may be carried out in order to prove that the formation provides effective annular seal. Such inflow testing may involve reducing pressure on one side of the seal rather that attempting to flow through the seal or pressuring up the seal to sufficient pressure in the manner of the seal tests described above.

It will also be appreciated that although the examples above have been described with reference to cement bond, acoustic/sonic and/or ultrasonic logging tools, the method could be performed with other types of wellbore tools (including both wireline or string mounted tools). Such wellbore tools may include other types of logging tool. Thus, the method could be performed by making use of different types of well logs and/or well log combinations. In turn, the characteristic response from the first well bore may be derived from one or more different kinds of well log. For example, the characteristic response could be represented by particular a datum and/or data type and/or combinations of data types, which may be for example found in different well bore logs.

The invention claimed is:

1. A method of determining integrity of an annular seal in a wellbore, the method comprising the steps of:

(a) providing a characteristic response that is associated with a geological formation providing an effective annular seal against a surface of a lining tubing section located in a wellbore;

(b) running at least one wellbore tool in a selected wellbore that extends through the geological formation to obtain selected wellbore response data associated with a property of the geological formation; and (c) comparing the selected wellbore response data with the characteristic response to determine whether the geological formation forms an effective annular seal against a surface of lining tubing section located in the selected wellbore.

2. A method according to claim 1, including the steps of:

(d) selecting first and second wellbores that extend through a common geological formation which is capable of sealing against first and second lining tubing sections located in the first and second wellbores respectively;

(e) performing a seal test in the first wellbore to determine that the geological formation forms an effective annular seal around the first lining tubing section of the first wellbore;

(f) running at least one wellbore tool in the first wellbore to obtain first response data associated with a property of the common geological formation and deriving the characteristic response from the first response data; and wherein the selected wellbore is the second wellbore and step (b) is performed in the second wellbore to obtain the selected wellbore response data in the form of second response data which are compared with the characteristic response according to step (c).

3. A method according to claim 1, including the step of identifying a geological formation that may be capable of providing an annular seal.

4. A method according to claim 2, wherein step (e) includes performing an inflow test.

5. A method according to claim 2, wherein step (e) includes performing a pressure test.

6. A method according to claim 5, wherein performing the pressure test includes pumping fluid into the first wellbore to increase pressure in the first wellbore to above at least a maximum expected pressure which the seal could be exposed to by well fluids.

7. A method according to claim 5, wherein performing the pressure test includes determining whether there is fluid flow across the geological formation providing the annular seal in the first wellbore.

8. A method according to claim 5, wherein performing the pressure test includes measuring a fracture pressure for the geological formation.

9. A method according to claim 5, wherein performing the pressure test includes perforating the first lining tubing section.

10. A method according to claim 5, including the steps of estimating an expected strength of the formation from reservoir models and comparing results from the pressure test with the estimated expected strength to verify that the formation provides an effective annular seal around the first lining tubing section.

11. A method according to claim 2, wherein the seal test is an extended leak off test.

12. A method according to claim 2, wherein the first and second response data include variable density log (VDL) data obtained by running a wellbore tool in the form of a cement bond logging tool in the first and second wellbores.

13. A method according to claim 2, wherein the first and second response data include cement bond log (CBL) data obtained by running a wellbore tool in the form of a cement bond logging tool in the first and second wellbores.

14. A method according to claim 2, wherein the first and second response data include ultrasonic azimuthal bond log data obtained by running a wellbore tool in the form of an ultrasonic scanning tool in the first and second wellbores.

15. A method according to claim 2, including the step of running the same wellbore tool in the first and second wellbores.

16. A method according to claim 2, including the step of running different wellbore tools in the first and second wellbores.

17. A method according to claim 2, including the step of calibrating the wellbore tool which is run to provide second response data that are validly comparable to the first response data.

18. A method according to claim 1, including the step of drilling a sidetrack wellbore through the selected wellbore.

19. Wellbore apparatus for performing a method according to claim 1.

20. Wellbore apparatus as claimed in claim 19, including at least one logging tool for obtaining response data.

21. Wellbore apparatus as claimed in claim 19, including pressure testing apparatus for verifying that the geological formation forms an effective annular seal around a lining tubing section.

* * * * *